US009459549B2

(12) United States Patent
Tatsuura et al.

(10) Patent No.: US 9,459,549 B2
(45) Date of Patent: Oct. 4, 2016

(54) LIQUID DEVELOPER, METHOD FOR CONTROLLING CHARGING PROPERTIES OF TONER, IMAGE FORMING APPARATUS, IMAGE FORMING METHOD, PROCESS CARTRIDGE, AND LIQUID DEVELOPER CARTRIDGE

(71) Applicant: FUJI XEROX CO., LTD., Tokyo (JP)

(72) Inventors: Satoshi Tatsuura, Kanagawa (JP); Keitaro Mori, Kanagawa (JP); Kazunari Komatsuzaki, Kanagawa (JP); Yutaka Nogami, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 13/965,753

(22) Filed: Aug. 13, 2013

(65) Prior Publication Data

US 2014/0295343 A1 Oct. 2, 2014

(30) Foreign Application Priority Data

Mar. 26, 2013 (JP) ..... 2013-064975

(51) Int. Cl.

| | |
|---|---|
| ***G03G 9/00*** | (2006.01) |
| ***G03G 9/135*** | (2006.01) |
| ***G03G 13/10*** | (2006.01) |
| ***G03G 9/125*** | (2006.01) |
| *G03G 15/10* | (2006.01) |

(52) U.S. Cl.

CPC ..... *G03G 9/1355* (2013.01); *G03G 9/125* (2013.01); *G03G 13/10* (2013.01); *G03G 15/10* (2013.01)

(58) Field of Classification Search

CPC ..... G03G 9/135; G03G 9/1355
USPC ..... 430/116, 115, 117.1, 112, 109.4; 399/237

See application file for complete search history.

(56) References Cited

U.S. PATENT DOCUMENTS

| | | | | |
|---|---|---|---|---|
| 6,777,154 | B2 * | 8/2004 | Takahashi et al. | 430/114 |
| 2010/0248128 | A1 * | 9/2010 | Mitsuzawa et al. | 430/114 |
| 2011/0177448 | A1 * | 7/2011 | Ueno et al. | 430/112 |

FOREIGN PATENT DOCUMENTS

| | | | |
|---|---|---|---|
| JP | A-2005-84258 | | 3/2005 |
| JP | A-2010-191222 | | 9/2010 |
| JP | A-2010-224300 | | 10/2010 |
| JP | 2011-150025 | A | 8/2011 |
| JP | 2011-150091 | A | 8/2011 |
| JP | 2011-170065 | A | 9/2011 |
| JP | 2011-221100 | A | 11/2011 |
| JP | 2012-118393 | A | 6/2012 |
| JP | 2012-123060 | A | 6/2012 |

OTHER PUBLICATIONS

Jul. 28, 2015 Office Action issued in Japanese Application No. 2013-064975.

* cited by examiner

*Primary Examiner* — Thorl Chea
(74) *Attorney, Agent, or Firm* — Oliff PLC

(57) ABSTRACT

A liquid developer includes a toner in which a compound having a charge-accepting functional group has been bonded to a surface of toner particles, and a carrier liquid which makes a charge density of a surface of the toner become 1 $\mu C/m^2$ or less when the toner is dispersed in the carrier liquid.

8 Claims, 3 Drawing Sheets

LIQUID DEVELOPER (C2)

LIQUID DEVELOPER (A1)

LIQUID DEVELOPER, METHOD FOR CONTROLLING CHARGING PROPERTIES OF TONER, IMAGE FORMING APPARATUS, IMAGE FORMING METHOD, PROCESS CARTRIDGE, AND LIQUID DEVELOPER CARTRIDGE

CROSS-REFERENCE TO RELATED APPLICATIONS

This application is based on and claims priority under 35 USC 119 from Japanese Patent Application No. 2013-064975 filed Mar. 26, 2013.

BACKGROUND

1. Technical Field

The present invention relates to a liquid developer, a method for controlling charging properties of toner, an image forming apparatus, an image forming method, a process cartridge, and a liquid developer cartridge.

2. Related Art

A liquid developer obtained by dispersing a toner in a carrier liquid is conventionally known.

SUMMARY

According to an aspect of the invention, there is provided a liquid developer including: a toner in which a compound having a charge-accepting functional group has been bonded to a surface of toner particles; and a carrier liquid which makes a charge density of a surface of the toner become 1 $\mu C/m^2$ or less when the toner is dispersed in the carrier liquid.

BRIEF DESCRIPTION OF THE DRAWINGS

Exemplary embodiments of the present invention will be described in detail based on the following figures, wherein.

DETAILED DESCRIPTION

Figure 1:
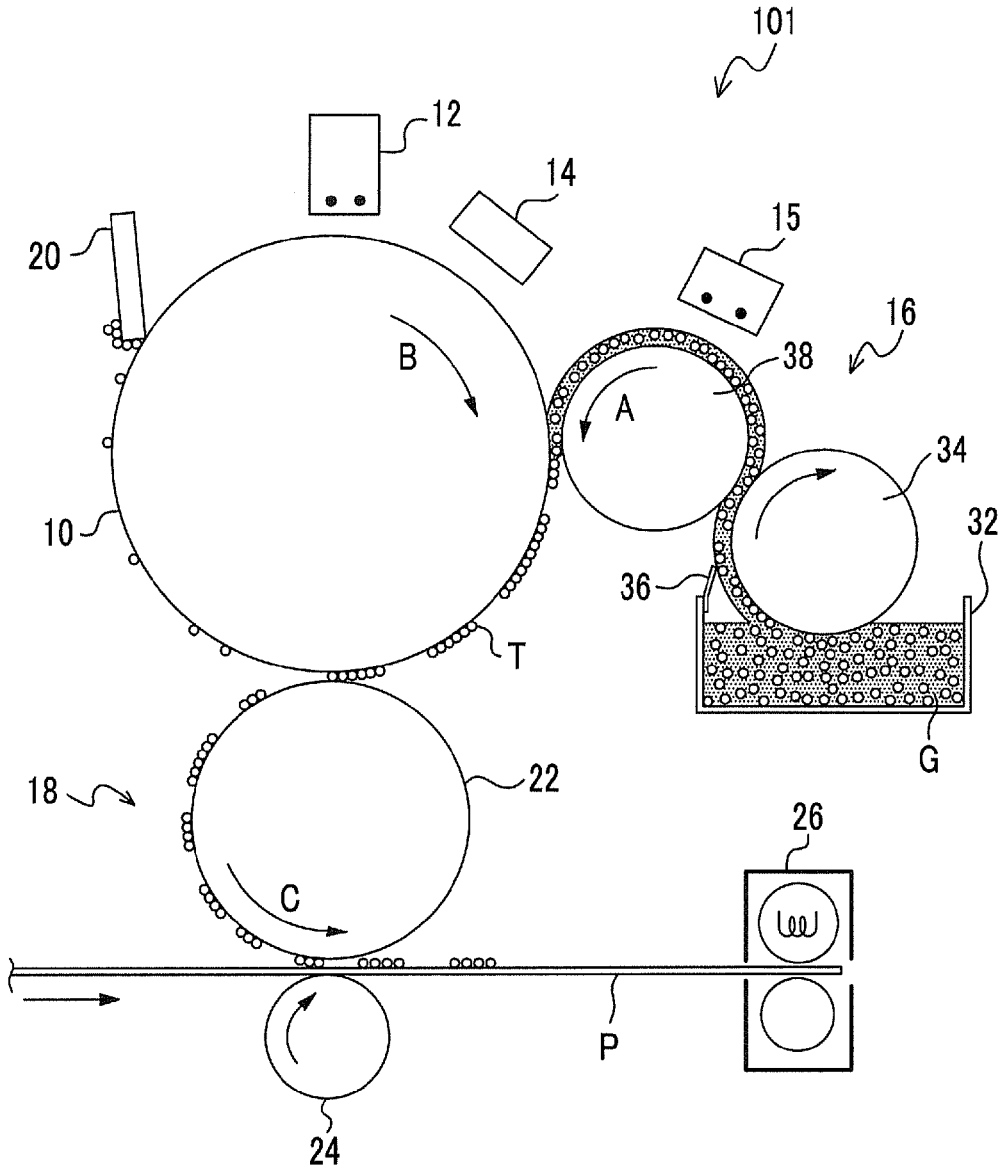
FIG. 1 is a schematic constitution view showing an example of an image forming apparatus according to the present exemplary embodiment.

Hereinafter, exemplary embodiments of the liquid developer, method for controlling charging properties of toner, image forming apparatus, image forming method, process cartridge, and liquid developer cartridge of the present invention will be described in detail.

Liquid Developer

The liquid developer according to the present exemplary embodiment contains a toner and a carrier liquid.

The toner is a toner in which a compound having a charge-accepting functional group has been bonded to the surface of toner particles. Herein, the term "bonded" means that a covalent bond or an ionic bond has been formed.

The carrier liquid is a carrier liquid which makes a charge density of the surface of the toner become 1 $\mu C/m^2$ or less when the toner is dispersed in the carrier liquid. That is, the carrier liquid is a carrier liquid in which the charge-accepting functional group of the toner is not easily ionized, and which makes a charge density of the toner surface become 1 $\mu C/m^2$ or less (makes the toner not charged or charged to an extremely small degree).

Due to the above configuration, in the liquid developer according to the present exemplary embodiment, the toner is charged excellently by a charger and maintains excellently the charge amount. The reason is assumed to be as below.

In order to improve image quality in a liquid developing system, the charge amount of toner needs to be increased to induce a mirror-image force, such that the force of toner attached to the surface of a roll (a developing roll or a photoreceptor) is strengthened, and resistance to disturbance such as flow of liquid is enhanced.

As the method for charging a toner in the liquid developing system, the following three methods are conventionally known.

(i) A method of attaching a compound having a dissociable group to the surface of toner so as to charge the toner by ionization of the dissociable group; hereinafter, the compound having a dissociable group in this method will be called a "charge-controlling agent".

(ii) A method of binding a compound having a dissociable group to the surface of toner so as to charge the toner by ionization of the dissociable group; hereinafter, the compound having a dissociable group in this method will be called a "surface modifier".

(iii) A method of supplying charge to the surface of toner by using a charger so as to charge the toner.

In the liquid developer to which the method (i) is applied, the charge amount of the toner is determined by the ionized state of the charge-controlling agent. Accordingly, in order to increase the charge amount of toner, it is preferable that the carrier liquid enable the charge-controlling agent to be in a highly ionized state.

On the other hand, in view of inhibiting unintended alteration of the constituent materials of toner or suppressing the conductivity of carrier liquid, it is preferable that the carrier liquid have a low solubility or a low polarity. That is, the carrier liquid is required to have properties that conflict with the properties realizing the ionized state of the charge-controlling agent.

Accordingly, in the method (i), it is not easy to make the charge-controlling agent be in a highly ionized state, and there is a limit in increasing the charge amount of the toner.

Moreover, the charge-controlling agent is sometimes detached from the toner surface due to environmental change caused during storage of the liquid developer or stress caused in an image forming process, and it is not easy to stabilize the charge amount of the toner.

In the liquid developer to which the method (ii) is applied, the surface modifier is chemically bonded (chemical bond including not only a covalent bond but also an ionic bond) to the toner surface. Accordingly, stability of the charge amount of the toner becomes higher, than in the liquid developer to which the method (i) is applied.

However, the charge amount of toner is determined by the ionized state of the dissociable group just like the method (i), so there is a limit in increasing the charge amount of toner.

In addition, in the liquid developer to which the method (i) or (ii) is applied, a counter ion of the ionized dissociable group is present around each toner, so the charge on the toner surface has been neutralized by the counter ion.

The strength of a mirror-image force, which is induced on the roll surface by the charge of toner, is important for the toner to be attached to a roll. Moreover, in the vicinity of the contact portion between the toner and the roll, counter ions are removed from the toner surface, so the mirror-image force may be induced on the roll surface. However, among charges of the toner, only a portion thereof in the vicinity of the contact portion contributes to the induction of mirror-image force, and the induced mirror-image force is small in consideration of the proportion of the total charge amount of toner. Therefore, due to disturbance such as flow of liquid or the like, the obtained image quality is sometimes poor in consideration of the proportion of the total charge amount of the toner.

Furthermore, due to the presence of counter ions, conductivity of the carrier liquid tends to increase, and sometimes the efficiency of applying voltage decreases at the time of developing or transfer.

In the liquid developer to which the method (iii) is applied, the charge supplied from a charger is attached onto the toner surface, whereby the toner is charged. Accordingly, this method is advantageous since ionization of the constituent materials of toner does not need to be taken into consideration, and the range of choice of the carrier liquid is wider compared to the method (i) or (ii). In addition, since a counter ion is not present, conductivity of the carrier liquid does not increase, and the entire charge of the toner may contribute to the induction of mirror-image force. Consequently, this method may realize a stronger mirror-image force, compared to the methods (i) and (ii).

However, as a result of examination conducted by the present inventors, it has been found that in the toner used in the conventional method (iii), the charge supplied from a charger is easily detached from the toner surface, and when the toner passes through a nip where a roll contacts another roll (for example, a developing nip where a developing roll contacts a photoreceptor), a considerable amount of charge is lost from the toner. Accordingly, as the image forming process proceeds, the charge amount of toner decreases, and as a result, image quality easily decreases.

As measures for suppressing decrease in image quality, for example, the methods described below may be considered. However, in any cases, it is not easy to sufficiently suppress the decrease in image quality.

First, there is a measure of anticipating decrease in the charge amount of toner and increasing the initial charge amount so as to make up for the decrease. However, if the decrease is made up, the initial charge amount becomes too large, so the toner is aggregated. Alternatively, the force of the toner attached to a roll becomes too strong since the mirror-image force is extremely strong in the first half of the process, so the roll-to-roll transition efficiency decreases, whereby image quality decreases.

Moreover, a measure of recharging the toner by a charger for each nip right in front of the nip may also be considered. However, originally, the charge is easily lost from the toner surface when the toner passes through the nip, so the effect of increasing the roll-to-roll transition efficiency is restricted.

For the reasons described so far, in any of the methods (i) to (iii), it is difficult to charge the toner to a high degree and maintain the charge amount at the same time.

On the other hand, the liquid developer according to the present exemplary embodiment makes it possible to charge the toner to a high degree and maintain the charge amount, by combining a toner, in which a compound having a charge-accepting functional group (hereinafter, also called a "charge-accepting group") has been bonded to the surface of toner particles, with a carrier liquid which makes a charge density of the toner surface become 1 $\mu C/m^2$ or less when the toner is dispersed in the carrier liquid.

The carrier liquid is a carrier liquid in which the charge-accepting group is not easily ionized and which makes a charge density of the toner surface become 1 $\mu C/m^2$ or less (makes the toner not charged or charged to an extremely small degree). The charge-accepting group surrounded by the carrier liquid is present in a state of practically not being ionized. It is considered that the charge-accepting group in the unionized state efficiently supplements the charge supplied from a charger, whereby a large charge amount may be realized.

Moreover, in the toner, a compound having the charge-accepting group has been bonded to the surface of toner particles. It is considered that for this reason, the charge-accepting group is not easily lost from the toner surface even by the stress caused during the image forming process, for example, even by passage through a nip, and the charge amount of the toner is maintained excellently.

In addition, the amount of counter ions does not increase even if the charge amount increases, and accordingly, neither the unintended increase in the conductivity of carrier liquid nor the unintended decrease in the strength of mirror-image force induced by the toner occurs.

In the liquid developer to which the method (ii) is applied, an ionized dissociable group is present on the toner surface. However, even if charge is supplied from a charger to the liquid developer in this state, the increase in the charge amount is not proportional to the amount of charge supplied. Presumably, this is because the ionized dissociable group is not able to efficiently supplement the charge from a charger since the ionized dissociable group is in a state of forming a pair with the counter ion.

The liquid developer according to the present exemplary embodiment modifies the toner surface by using the functional group responsible for charging, and in this respect, the liquid developer is the same as the liquid developer to which the method (ii) is applied. However, the liquid developer of the present exemplary embodiment is characterized by causing the functional group responsible for charging to be present in an unionized state as far as possible, and for this reason, the carrier liquid is combined with the liquid developer.

The carrier liquid of the present exemplary embodiment is a carrier liquid which makes a charge density of the toner surface become 1 $\mu C/m^2$ or less when the toner, in which a compound having the charge-accepting group has been bonded to the surface thereof, is dispersed in the carrier liquid. The "charge density of the toner surface of 1 $\mu C/m^2$ or less" means a charge amount in which the toner does not respond to an electric field and electrophoresis is not observed.

Accordingly, when the liquid developer containing only the toner and carrier liquid is used to form an image without supplying charge from a charger, an image may not be formed since developing or transfer does not occur.

Whether the carrier liquid is a carrier liquid, which makes a charge density of the toner surface become 1 $\mu C/m^2$ or less when the toner in which a compound having the charge-accepting group has been bonded to the surface thereof is dispersed in the carrier liquid, is confirmed by the following method.

10 mm×20 mm ITO electrode pairs are caused to face to each other with a gap of 50 μm, and a liquid developer at a certain concentration is put into the gap. A preset voltage is applied between the electrodes for a certain time, and a charge amount Q1 that flows therebetween is recorded. In addition, a liquid developer at the same concentration is subjected to centrifugation, the supernatant liquid is measured in the same manner, and a charge amount Q2 is recorded. The charge amount of the toner is calculated by Q1−Q2 and is divided by a surface area of the toner that is obtained from the concentration and the particle size of the toner, whereby a surface charge density of the toner is determined.

The instruments used for the measurement are as follows, for example.

Power source: manufactured by NF Corporation, HSA4052

Ammeter: manufactured by Keithley Instruments Inc, 6514

Function generator: manufactured by NF Corporation, WF1974

Oscilloscope: manufactured by KEYENCE CORPORATION, NR-500, NR-HA08

Hereinafter, the constituent of the liquid developer according to the present exemplary embodiment will be described in detail.

Compound Having Charge-Accepting Functional Group

The toner of the present exemplary embodiment is a toner in which a compound (hereinafter also called a "surface-modifying compound") having a charge-accepting functional group (charge-accepting group) has been bonded to the surface of toner particles.

The charge-accepting group is specifically a polar group. The surface-modifying compound is preferably a compound having two or more polar groups, more preferably a compound having three or more polar groups, and even more preferably a compound having five or more polar groups.

Examples of charge-accepting groups that may be positively charged by supplementing positive charge include an amino group, an imino group, and the like.

Examples of surface-modifying compound having the above charge-accepting group include polyalkylenimine such as polyethylenimine, polypropylenimine, polybutylenimine, and polyisopropylenimine. Polyalkylenimine (polyethylenimine, polypropylenimine, polybutylenimine, polyisopropylenimine, and the like) is preferable in the respect that it has a high density of the charge-accepting group and may supplement positive charge with a high density.

An amine value of the surface-modifying compound is preferably in a range of from 500 mg KOH/g to 1,300 mg KOH/g, and more preferably in a range of from 800 mg KOH/g to 1,200 mg KOH/g.

Examples of charge-accepting groups that may be negatively charged by supplementing negative charge include a carboxyl group, a sulfa group, a phosphate group, a hydroxy group, a nitrile group, and the like.

Examples of the surface-modifying compound having the above charge-accepting group include polyvalent carboxylic acid such as oxalic acid, succinic acid, and terephthalic acid. Polyvalent carboxylic acid is preferable in view of realizing a large charge amount.

An acid value of the above surface-modifying compound is preferably in a range of from 300 mg KOH/g to 1,300 mg KOH/g, and more preferably in a range of from 800 mg KOH/g to 1,200 mg KOH/g.

The type of surface-modifying compound may be selected among surface-modifying compounds that are easily bonded to a binder resin constituting the toner particles and stably present in the liquid developer.

For example, when the binder resin is a polyester resin, as the surface-modifying compound, compounds having an amino group that forms a covalent bond or an ionic bond with a carboxyl group of the polyester resin are preferable. Specifically, polyalkylenimine (polyethylenimine, polypropylenimine, polybutylenimine, polyisopropylenimine, and the like) is preferable, and polyethylenimine is more preferable.

For example, when the binder resin is a styrene/acrylic resin and has an amino group derived from an acrylic acid ester, as the surface-modifying compound, compounds having a carboxyl group that forms a covalent bond or an ionic bond with the amino group are preferable. Specifically, polyvalent carboxylic acid (for example, oxalic acid, succinic acid, terephthalic acid, and the like) is preferable.

In the present exemplary embodiment, as the surface-modifying compound, polyalkylenimine (polyethylenimine, polypropylenimine, polybutylenimine, polyisopropylenimine, and the like) is particularly preferable.

Polyalkylenimine is suitable as a surface-modifying compound of negatively charged toner particles, when toner particles that are originally charged negatively (for example, toner particles containing a polyester resin as a binder resin) are applied to a positively charged liquid developer.

The surface-modifying compound preferably covers 80% or more of the toner surface, and more preferably covers 95% or more of the toner surface, in the respect that the surface of toner particles are uniformly modified by the surface-modifying compound.

Toner Particles

The toner particles preferably contain a binder resin and a colorant, and may contain a release agent or various internal and external additives.

Examples of the binder resin include homopolymers or copolymers of styrenes such as styrene and chlorostyrene; monoolefins such as ethylene, propylene, butylene, and isobutylene; vinyl esters such as vinyl acetate, vinyl propionate, and vinyl benzoate; α-methylene aliphatic monocarboxylic acid esters such as methyl acrylate, ethyl acrylate, butyl acrylate, octyl acrylate, dodecyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; vinyl ketones such as vinyl methyl ketone, vinyl hexyl ketone, and vinyl isopropenyl ketone; and the like.

Typical examples of the binder resin include polyester, polystyrene, a styrene/acrylic resin, a styrene-acrylonitrile copolymer, a styrene-butadiene copolymer, a styrene-maleic anhydride copolymer, polyethylene, polypropylene, polyurethane, an epoxy resin, a silicone resin, polyamide, modified rosine, paraffin, and waxes.

For the binder resin, an embodiment of concurrently using an amorphous resin and a crystalline resin is preferable.

In the present exemplary embodiment, a "crystalline resin" refers to a resin that does not show stepwise change in endothermic amount but has a clear endothermic peak in differential scanning calorimetry (DSC). On the other hand, a resin that does not have a clear endothermic peak is regarded as an amorphous resin.

When the amorphous resin is an amorphous polyester resin, a glass transition temperature (Tg) thereof is preferably from 50° C. to 80° C., and more preferably from 55° C. to 65° C. The weight average molecular weight of the amorphous polyester resin is preferably from 8,000 to 30,000, and more preferably from 8,000 to 16,000.

In order to obtain low temperature fixability and storage stability of the toner, it is preferable that the melting temperature of the crystalline resin be within a range of from 45° C. to 110° C. The melting temperature is more preferably within a range of from 50° C. to 100° C., and even more preferably within a range of from 55° C. to 90° C.

As the crystalline resin, a resin having a weight average molecular weight of greater than 5,000 is preferable, and specific examples thereof include a crystalline polyester resin and a crystalline vinyl-based resin. Among these, a crystalline polyester resin is preferable.

The content of the crystalline resin in the toner particles is preferably from 1% by weight to 10% by weight, and more preferably from 2% by weight to 8% by weight.

The colorant may be selected according to the shade of toner.

Examples of the colorant include carbon black, nigrosine, aniline blue, calco oil blue, chrome yellow, ultramarine blue, Dupont oil red, quinoline yellow, methylene blue chloride, phthalocyanine blue, malachite green/oxalate, lamp black, rose bengal, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, and C.I. Pigment Blue 15:3, and the like.

The toner particles may contain a release agent for the purpose of preventing offset or the like. Examples of the release agent include paraffin wax and derivatives thereof, montan wax and derivatives thereof, microcrystalline wax and derivatives thereof, Fischer-Tropsch wax and derivatives thereof, polyolefin wax and derivatives thereof, low-molecular weight polypropylene, low-molecular weight polyethylene, polymer alcohols, fatty acids, plant wax, animal wax, mineral wax, ester wax, acid amid, and the like. The derivative includes oxides, polymers with vinyl monomers, and substances modified by grafting.

The content of the release agent is preferably from 0.5% by weight to 50% by weight, more preferably from 1% by weight to 30% by weight, and even more preferably from 5% by weight to 15% by weight, based on the toner particles.

The toner particles may contain inorganic oxide particles. Examples of the inorganic oxide particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and the like. Among these, silica particles and titania particles are preferable. The surface of the inorganic oxide particles may or may not be subjected to hydrophobization treatment in advance.

The volume average particle size of the toner particles is preferably from 0.5 μm to 6 μm, and more preferably from 2 μm to 4 μm.

GSDv as a volume average particle size distribution index of the toner particles is preferably from 1.15 to 1.25.

The GSDv as a volume average particle size distribution index is measured by using, for example, a Coulter Multisizer II (manufactured by Beckman Coulter, Inc.) and ISOTON-II (manufactured by Beckman Coulter, Inc.) as an electrolytic solution. Regarding the particle size ranges (channels) obtained by dividing the measured particle size distribution, the cumulative volume distribution is drawn starting from the small size particles. The particle size that becomes cumulative 16% is defined as $D_{16v}$, the particle size that becomes cumulative 50% is defined as $D_{50v}$, and the particle size that becomes cumulative 84% is defined as $D_{84v}$. By using these, the GSDv as a volume average particle size distribution index is calculated by $(D_{84v}/D_{16})^{1/2}$. In addition, the volume average particle size is a value obtained as the $D_{50v}$.

Examples of methods for preparing the toner particles include a kneading and pulverizing method in which a binder resin, a colorant, a release agent, and the like are kneaded, pulverized, and classified; a method in which the shape of the particles obtained by the kneading and pulverizing method is changed by mechanical impact or heat energy; an emulsion aggregation method in which a dispersion obtained by emulsifying and dispersing a binder resin is mixed with each of the colorant dispersion, the release agent dispersion, and the like, and the mixture is caused to undergo aggregation and coalescence by heating to obtain toner particles; an emulsion polymerization aggregation method in which a dispersion obtained by emulsion polymerization of a polymerizable monomer constituting a binder resin is mixed with each of the colorant dispersion, the release agent dispersion, and the like, and the mixture is caused to undergo aggregation and coalescence by heating to obtain toner particles; a suspension polymerization method in which a polymerizable monomer for obtaining a binder resin and each of the colorant solution and the release agent solution are polymerized by being suspended in an aqueous solvent; a dissolution suspension method in which each of the binder resin solution, the colorant solution, the release agent solution, and the like is suspended in an aqueous solvent to prepare particles; and the like.

The examples also include a method for preparing toner particles having a core-shell structure by using the particles obtained by the above method as a core, attaching resin particles thereto, and causing the resultant to coalesce by heating.

Modification Treatment of Surface of Toner Particles

Bonding (also called "modification treatment") of the surface-modifying compound to the surface of toner particles may be realized by, for example, mixing an aqueous dispersion containing the toner particles (hereinafter, also called a "toner particle dispersion") with the surface-modifying compound and stirring the mixture.

In order to efficiently proceed the modification treatment, the solid content concentration of the toner particles in the toner particle dispersion is preferably from 1% by weight to 30% by weight.

In order to uniformly modify the surface of toner particles, the amount of the surface-modifying compound used is preferably from 0.5% by weight to 5% by weight based on the amount of solid content of the toner particles.

During the modification treatment, in order to efficiently proceed the modification treatment while suppressing unintended alteration of the constituent materials of toner particles, it is preferable to adjust pH of the toner particle dispersion within a range of, for example, 3 to 6.

The modification treatment may be performed at room temperature (for example, from 15° C. to 25° C.), or may be performed by heating the mixed liquid containing the toner particle dispersion and the surface-modifying compound at, for example, 30° C. to 40° C. The mixed liquid may be stirred for, for example, one hour to three hours.

After the modification treatment, the toner particles are separated, washed with water, and dried to obtain the toner of the present exemplary embodiment. The drying is, for example, freeze-drying or vacuum-drying.

The toner obtained in this manner is dispersed in a carrier liquid to obtain a liquid developer. The proportion of the toner in the liquid developer is preferably from 10% by weight to 50% by weight, and more preferably from 20% by weight to 40% by weight.

Carrier Liquid

The carrier liquid of the present exemplary embodiment is a carrier liquid which makes a charge density of the toner surface become 1 $\mu C/m^2$ or less when the toner is dispersed in the carrier liquid.

The carrier liquid of the present exemplary embodiment is preferably a carrier liquid which is colorless and transparent and excellent in storage stability, has a low vapor pressure, a high flash point, and a high electrical resistance, and is less hazardous to the human body.

Examples of the carrier liquid usable in the present exemplary embodiment include dimethyl silicone oil, methylphenyl silicone oil, and the like.

Among these, in the dimethyl silicone oil, components constituting the toner do not easily dissolve, and the charge-accepting group on the toner surface is not easily ionized. Accordingly, if charge is supplied thereto from a charger, the toner may be more efficiently charged to a high degree.

One kind of the carrier liquid may be used alone, or two or more kinds thereof may be used by being mixed with each other.

The electrical resistance at 20° C. of the carrier liquid is preferably $10^{11}$ Ωcm or higher, more preferably $10^{12}$ Ωcm or higher, and even more preferably $10^{13}$ Ωcm or higher.

The flash point of the carrier liquid is, for example, 100° C. or higher, and preferably 150° C. or higher.

Ionization-Controlling Agent

The liquid developer according to the present exemplary embodiment may contain an ionization-controlling agent that ionizes the charge-accepting group on the toner surface.

The group that has been ionized and neutralized by the counter ion contributes to migration of the toner but does not contribute much to induction of a mirror-image force. In addition, the group that has been ionized and neutralized by the counter ion is not considered to be able to efficiently supplement the charge supplied from a charger.

Accordingly, if a portion of the charge-accepting group on the toner surface is ionized in advance by the ionization-controlling agent, the mirror-image force of the toner may be suppressed. If the mirror-image force of the toner is too strong, the toner is not easily detached from a roll (a developing roll or a photoreceptor), so the transition efficiency (developing efficiency or transfer efficiency) of the toner decreases in some cases. The ionization-controlling agent may be used for the purpose of inhibiting such a phenomenon.

The type of ionization-controlling agent is selected according to the type of charge-accepting group in the surface-modifying compound.

In the case of the charge-accepting group such as an amino group or an imino group that supplements positive charge, examples of the ionization-controlling agent include acid-modified silicone (for example, hydrogen-modified silicone and carboxyl-modified silicone) and the like.

In the case of the charge-accepting group such as a carboxyl group that supplements negative charge, examples of the ionization-controlling agent include amino-modified silicone and the like.

These silicone derivatives are excellently compatible with dimethyl silicone suitable for the carrier liquid and efficiently ionize the charge-accepting group, so these make it easy to control the developing efficiency or transfer efficiency. Examples of commercially available silicone derivatives include modified silicone oil manufactured by Shin-Etsu Chemical Co., Ltd. and the like.

The amount of the ionization-controlling agent to be added is, for example, preferably from 0.01% by weight to 2% by weight, and more preferably from 0.05% by weight to 0.5% by weight, based on the developer having a toner concentration of 30% by weight, though the amount depends on the acid value or amine value of the surface-modifying compound.

Other Components

The liquid developer according to the present exemplary embodiment may contain other components such as a dispersant, an emulsifier, a surfactant, a stabilizer, a moisturizing agent, a thickener, a defoaming agent, an antisettling agent, an antioxidant, an antiadhesive agent, a fragrance-imparting agent, and the like.

Method for Controlling Charging Properties of Toner

For the liquid developer according to the present exemplary embodiment, the following method for controlling charging properties of a toner is provided. That is, in the method for controlling charging properties of a toner, charging properties of the toner are controlled by selecting an acid value or an amine value of a surface-modifying compound which is used for preparing the toner.

The amount (μC/g) of charge per unit weight that may be supplemented by the toner surface varies with the density of the charge-accepting group in the surface-modifying compound. Accordingly, by selecting the acid value or amine value of the surface-modifying compound, charging properties (in other words, potential charge amount) of the toner may be controlled.

As the method for controlling charging properties of a toner, there is a control method using the amount of surface-modifying compound bonded to the toner surface. However, it is not easy to control the amount of the surface-modifying compound bonded. Therefore, the charging properties of the toner may be more easily controlled by the present method which selects, as the surface-modifying compound used for preparing the toner, a surface-modifying compound having an acid value or an amine value within a target range.

Each of the acid value and amine value of the surface-modifying compound is preferably within the range described above. Moreover, the surface-modifying compound having an acid value or amine value within a target range may be selected according to the constitution such as a charging unit, a developing unit, and a transfer unit in an image forming apparatus.

In addition, it is preferable that the toner of the present exemplary embodiment be charged by a charger, within a range of from 300 μC/g to 1,800 μC/g in terms of an absolute value. The more preferable amount varies with the particle size (surface area) of the toner, and in the case of a toner having a particle size of, for example, 4 μm, the charge amount is preferably from 400 μC/g to 700 μC/g.

Image Forming Apparatus and Image Forming Method

The image forming apparatus according to the present exemplary embodiment includes an image holding member, a first charging unit that charges a surface of the image holding member, a latent image forming unit that forms an electrostatic latent image on a charged surface of the image holding member, a second charging unit that charges a toner contained in a liquid developer, a developing unit that accommodates the liquid developer and develops the electrostatic latent image formed on the surface of the image holding member by using the liquid developer containing the toner charged by the second charging unit to forma toner image, a transfer unit that transfers the toner image to a recording medium, and a fixing unit that fixes the toner image to the recording medium. As the liquid developer, the liquid developer according to the present exemplary embodiment is used.

In the image forming apparatus according to the present exemplary embodiment, an image forming method (image forming method according to the present exemplary embodiment), which includes a first charging step for charging a surface of an image holding member, a latent image forming step for forming an electrostatic latent image on a charged surface of the image holding member, a second charging step for charging a toner contained in a liquid developer, a developing step for developing the electrostatic latent image formed on the surface of the image holding member by using the liquid developer containing the toner charged by the second charging step to form a toner image, a transfer step for transferring the toner image to a recording medium, and a fixing step for fixing the toner image to the recording medium, is performed.

In the image forming apparatus according to the present exemplary embodiment, for example, the portion including the developing unit may have a cartridge structure (process cartridge) that is detachable from the image forming apparatus. As the process cartridge, for example, a process cartridge that accommodates the liquid developer according to the present exemplary embodiment and includes a developing unit is preferably used.

In the image forming apparatus according to the present exemplary embodiment, for example, the portion accommodating the liquid developer may have a cartridge structure (liquid developer cartridge) that is detachable from the image forming apparatus. As the liquid developer cartridge, for example, a liquid developer cartridge accommodating the liquid developer according to the present exemplary embodiment is preferably used.

Hereinafter, the image forming apparatus according to the present exemplary embodiment will be described with reference to drawings.

FIG. 1 is a schematic constitution view of an example of the image forming apparatus according to the present exemplary embodiment.

An image forming apparatus 101 shown in FIG. 1 is a wet-type image forming apparatus, and includes a photoreceptor 10 (an examples of image holding member), a charging device 12 (an example of first charging unit), an exposure device 14 (an example of latent image forming unit), a charging device 15 (an example of second charging unit), a developing device 16 (an example of developing unit), a transfer device 18 (an example of transfer unit), a fixing device 26 (an example of fixing unit), and a cleaner 20.

The charging device 12 charges the surface of the photoreceptor 10.

The exposure device 14 exposes the charged surface of the photoreceptor 10 to, for example, laser beams based on image signals, thereby forming an electrostatic latent image.

The developing device 16 is a wet-type developing device and includes a developer-accommodating container 32, a developer supply roll (anilox roll) 34, a regulating member 36, and a developing roll 38.

The developer-accommodating container 32 accommodates a liquid developer G. The developer-accommodating container 32 may be equipped with a stirring member (not shown in the drawing) for stirring the liquid developer G.

A portion of the developer supply roll 34 is dipped in the liquid developer G accommodated in the developer-accommodating container 32, disposed so as to come close to (or contact) the developing roll 38, and supplies the liquid developer G in the developer-accommodating container 32 to the surface of the developing roll 38. The regulating member 36 controls the amount of the liquid developer G supplied by the developer supply roll 34.

The developing roll 38 keeps the liquid developer G supplied from the developer supply roll 34. On the developing roll 38, charge is provided to the toner contained in the liquid developer G by the charging device 15, whereby the liquid developer G is charged. An electrostatic latent image that is formed on the surface of the photoreceptor 10 by the charged liquid developer G is developed into a toner image T by the developing roll 38.

The charging device 15 is disposed in the upstream of the position where the developing roll 38 comes close to (or contact) the photoreceptor 10, in the vicinity of the developing roll 38. The charging device 15 provides charge to the toner contained in the liquid developer G supplied onto the developing roll 38, thereby charging the liquid developer G.

The charging device 15 preferably has output that charges the toner in the liquid developer G at 300 μC/g or more, and more preferably has output that charges the toner at 400 μC/g or more, in terms of an absolute value.

The transfer device 18 is constituted with a device that employs an intermediate transfer method and includes a drum-like intermediate transfer member 22 to which the toner image T having been formed on the surface of the photoreceptor 10 is transferred, and a transfer roll 24 that transfers the toner image T having been transferred onto the surface of the intermediate transfer member 22 to a recording medium P.

The transfer device 18 may be constituted with, for example, a belt-like intermediate transfer member 22. The transfer device 18 may not include the intermediate transfer member 22 and may have a constitution of a direct transfer method in which the toner image T is directly transferred to the recording medium P from the photoreceptor 10 by the transfer roll 24.

The fixing device 26 applies pressure to the toner image T on the recording medium P under heating, thereby fixing the toner image T to the recording medium P. The fixing method in the fixing device 26 may be contact fusing performed by a roll or a belt, or non-contact fusing performed by an oven, a flash lamp, or the like. In addition, when a UV curable liquid developer is used, fixing is performed using a UV lamp or the like.

The cleaner 20 is disposed for the purpose of removing and collecting the toner residue that remains on the surface of the photoreceptor 10 after the toner image T is transferred.

The image forming apparatus 101 may further include an erasing device (not shown in the drawing) that eliminates the electricity on the surface of the photoreceptor 10 after transfer and before the next charging.

Hereinafter, the image forming method using the image forming apparatus 101 will be described.

The charging device 12, the exposure device 14, the charging device 15, the developing device 16, the transfer device 18, the fixing device 26, and the cleaner 20 are operated in synchronization with the rotation speed of the photoreceptor 10.

First, the charging device 12 charges the surface of the photoreceptor 10, which rotates in the direction of arrow B, with preset potential.

Next, the exposure device 14 exposes the charged surface of the photoreceptor 10 based on image signals, thereby forming an electrostatic latent image.

In the developing device 16, the developer supply roll 34 supplies the liquid developer G onto the surface of the developing roll 38, and the developing roll 38 feeds the liquid developer G to the photoreceptor 10.

While being fed to the photoreceptor 10, the liquid developer G is charged on the developing roll 38 by the charging device 15. In a position where the developing roll 38 comes close to (or contact) the photoreceptor 10, the charged liquid developer G is supplied to the electrostatic latent image on the photoreceptor 10, and the electrostatic latent image is developed (made into a visual image) and formed into the toner image T.

Thereafter, the toner image T on the surface of the photoreceptor 10 is transferred onto the surface of the intermediate transfer member 22 that rotates in the direction of arrow C.

Subsequently, the toner image T having been transferred onto the surface of the intermediate transfer member 22 is transferred to the recording medium P, in a position which contacts the transfer roll 24. In this transfer process, the recording medium P is interposed between the transfer roll 24 and the intermediate transfer member 22, and the toner image T on the surface of the intermediate transfer member 22 is adhered to the recording medium P.

Next, The recording medium P to which the toner image T has been transferred is transported to the fixing device 26 and interposed between a pair of fixing rolls in the fixing device 26, and pressure is applied thereto under heating, whereby the toner image T is fixed onto the surface of the recording medium P. In this manner, a fixed image is formed on the surface of the recording medium P.

The photoreceptor 10 from which the toner image T has been transferred to the intermediate transfer member 22 is cleaned by the cleaner 20 so as to remove and collect the toner residue remaining after transfer, and then moved again for the following charging step.

Process Cartridge and Liquid Developer Cartridge

The process cartridge according to the present exemplary embodiment is a process cartridge which includes a charging unit that charges the toner contained in the liquid developer according to the present exemplary embodiment and a developing unit that accommodates the liquid developer according to the present exemplary embodiment and develops an electrostatic latent image formed on the surface of an image holding member by using the liquid developer containing a toner charged by the charging unit to form a toner image, and is detachable from an image forming apparatus.

The process cartridge according to the present exemplary embodiment may have a constitution further including at least a unit selected from other units such as an image holding member, a first charging unit, an electrostatic latent image forming unit, a transfer unit, and a fixing unit.

The liquid developer cartridge according to the present exemplary embodiment is a liquid developer cartridge which accommodates the liquid developer according to the present exemplary embodiment and is detachable from an image forming apparatus.

For example, in the image forming apparatus shown in FIG. 1, the developer-accommodating container 32 may be the liquid developer cartridge according to the present exemplary embodiment. When the amount of the liquid developer stored in the cartridge has decreased, the cartridge is replaced.

EXAMPLES

Hereinafter, the present invention will be described in more detail based on examples, but the present invention is not limited to the following examples.

In the following description, "part(s)" is based on weight, unless otherwise specified.

Method for Measuring Various Physical Properties

Molecular Weight of Resin

The molecular weight (expressed in terms of polystyrene) of resin is measured by Gel Permeation Chromatography (GPC) under the following measurement conditions by using the following measurement instruments.

Measurement instrument: HLC-8120 GPC, SC-8020 (manufactured by TOSOH CORPORATION)

Column: TSKgel SuperHM-H (6.0 mm ID×15 cm×2 columns) (manufactured by TOSOH CORPORATION)

Eluent: tetrahydrofuran (THF)

Measurement condition: sample concentration of 0.5%, flow rate of 0.6 mL/min, sample injection amount of 10 μL, measurement temperature of 40° C., detection using an RI detector; A calibration curve is created from 10 samples including "A-500", "F-1", "F-10", "F-80", "F-380", "A-2500", "F-4", "F-40", "F-128", and "F-700" of "polystyrene standard sample TSK standards" manufactured by TOSOH CORPORATION.

Volume Average Particle Size of Particles

The volume average particle size of the particles is measured by the following method.

For particle size of 2 μm or larger

Sample for measurement: particles in an amount of from 0.5 mg to 50 mg are added to 2 mL of a 5% aqueous solution of sodium alkylbenzene sulfonate (surfactant), and the solution is added to an electrolytic solution (manufactured by Beckman Coulter, Inc., Isoton II) in an amount of from 100 mL to 150 mL, followed by dispersing treatment for 1 minute by using an ultrasonic dispersing machine, thereby preparing a sample.

Measurement instrument: Coulter Multisizer II model (manufactured by Beckman Coulter, Inc.), an aperture diameter of 100 μm By using the above measurement sample and measurement instrument, the particle sizes of 50,000 particles of 2 μm to 60 μm are measured, and the volume average particle size distribution is obtained from the particle size distribution.

Regarding the particle size ranges (channels) obtained by dividing the particle size distribution, the cumulative volume distribution is drawn starting from the small size particles, and the particle size that becomes cumulative 50% is taken as a volume average particle size.

For particles size of smaller than 2 μm

Sample for measurement: deionized water is added to a particle dispersion containing 2 g of solid contents, thereby obtaining 40 mL of a sample for measurement.

Measurement instrument: laser diffraction type particle size distribution analyzer (LA-700 manufactured by HORIBA, Ltd.)

The above sample for measurement is put into a cell until an appropriate concentration is obtained. In a point of time when the concentration in the cell is stabilized after two minutes, measurement is performed. The volume average particle size obtained for each channel is accumulated from the particles having a small volume average particle size, and the particle size that becomes cumulative 50% is taken as a volume average particle size.

Melting Temperature and Glass Transition Temperature of Resin

The melting temperature and glass transition temperature are obtained by a main peak measured by differential scanning calorimetry (DSC) based on ASTMD 3418-8.

The main peak is measured using DSC-7 manufactured by PerkinElmer Co., Ltd. For correcting the temperature of a detection portion of this instrument, the melting temperature of indium and zinc is used, and for correcting calories, the heat of fusion of indium is used. The sample is measured using an aluminum pan at a temperature increase rate of 10° C./min, and an empty pan is set for control.

Preparation of Toner Particles (1)

Preparation of Amorphous Polyester Resin (1)

| | |
|---|---|
| Polyoxyethylene(2,0)-2,2-bis(4-hydroxyphenyl)propane | 35 parts by mol |
| Polyoxypropylene(2,2)-2,2-bis(4-hydroxyphenyl)propane | 65 parts by mol |
| Terephthalic acid | 76 parts by mol |
| n-Dodecenyl succinate | 14 parts by mol |
| Trimellitic acid | 10 parts by mol |

The above materials and dibutyl tinoxide (0.05 part by mol based on 100 parts by mol of the total amount of the above acid components) are put into a two-necked flask having been dried by heating, and the temperature thereof is increased under in an inert atmosphere that is kept by putting nitrogen gas into the container. Thereafter, a co-condensation polymerization reaction is performed for 12 hours at 150° C. to 230° C., and then the pressure thereof is slowly reduced at 210° C. to 250° C., thereby obtaining an amorphous polyester resin (1).

The weight average molecular weight of the amorphous polyester resin (1) is 15,000, and the number average molecular weight thereof is 6,800.

The melting temperature (Tm) of the amorphous polyester resin (1) is measured using a differential scanning calorimeter (DSC). As a result, a clear peak is not shown, and stepwise change in endothermic amount is observed. The glass transition temperature determined from the midpoint in the stepwise change in endothermic amount is 62° C.

Preparation of Amorphous Resin Particle Dispersion (1)

3,000 parts of the amorphous polyester resin (1), 10,000 parts of deionized water, and 90 parts of sodium dodecylbenzene sulfonate as a surfactant are put into an emulsifying tank of an emulsifying machine (Cavitron CD1010, a slit of 0.4 mm), and the mixture is melted by heating at 130° C. and then dispersed at 10,000 rotations for 30 minutes at 110° C. The resultant is caused to pass through a cooling tank at a flow rate of 3 L/min so as to collect a resin particle dispersion, thereby obtaining an amorphous resin particle dispersion (1).

The volume average molecular weight of the resin particles contained in the amorphous resin particle dispersion (1) is 0.2 Jim, and a standard deviation thereof is 1.2

Preparation of Crystalline Polyester Resin (2)

| | |
|---|---|
| 1,4-Butanediol | 293 parts |
| Dodecanedicarboxylic acid | 750 parts |
| Catalyst (dibutyltin oxide) | 0.3 part |

The above materials are put into a three-necked flask having been dried by heating, and by a pressure reduction operation, the air inside the container is purged with nitrogen gas so as to make an inert atmosphere. The material are stirred mechanically for 2 hours at 180° C. and then stirred for 5 hours under reduced pressure while the temperature thereof is being slowly increased to 230° C. The resultant is cooled by air when it becomes viscous, and the reaction is stopped, thereby obtaining a crystalline polyester resin (2).

The weight average molecular weight of the crystalline polyester resin (2) is 18,000.

The melting point (Tm) of the crystalline polyester resin (2) is measured using a differential scanning calorimeter (DSC). As a result, a clear peak is found, and the temperature of the peak top is 70° C.

Preparation of Crystalline Resin Particle Dispersion (2)

A crystalline resin particle dispersion (2) is prepared under the same conditions as in the case of the amorphous resin particle dispersion (1), except that the crystalline polyester resin (2) is used.

The volume average particle size of the particles contained in the crystalline resin particle dispersion (2) is 0.2 μm, and the standard deviation thereof is 1.3.

Preparation of Colorant Dispersion (1)

| | |
|---|---|
| Phthalocyanine pigment (manufactured by Dainichiseika Color & Chemicals Mfg. Co., Ltd., PVFASTBLUE) | 25 parts |
| Anionic surfactant (manufactured by DAI-ICHI KOGYO SEIYAKU CO., LTD., Neogen RK) | 2 parts |
| Deionized water | 125 parts |

The above materials are mixed together and subjected to dispersion treatment by using a homogenizer (manufactured by IKA, Ultra-Turrax), thereby obtaining a colorant dispersion (1).

Preparation of Release Agent Particle Dispersion (1)

| | |
|---|---|
| Pentaerythritol behenic acid tetraester wax | 100 parts |
| Anionic surfactant (manufactured by NOF CORPORATION, Newrex R) | 2 parts |
| Deionized water | 300 parts |

The above materials are mixed together and subjected to dispersion treatment by using a homogenizer (manufactured by IKA, Ultra-Turrax). The resultant is subjected again to dispersion treatment by using a pressure-ejection type homogenizer, thereby obtaining a release agent particle dispersion (1).

Preparation of Inorganic Particle Dispersion (1)

| | |
|---|---|
| Hydrophobic silica (manufactured by AEROSIL Japan, RX200) | 100 parts |
| Anionic surfactant (manufactured by NOF CORPORATION, Newrex R) | 2 parts |
| Deionized water | 1,000 parts |

The above materials are mixed together and subjected to dispersion treatment by using a homogenizer (manufactured by IKA, Ultra-Turrax). The resultant is subjected again to dispersion treatment of 200 passes by using an ultrasonic homogenizer (RUS-600CCVP, manufactured by NISSEI Corporation), thereby obtaining an inorganic particle dispersion (1).

Preparation of Toner Particles (1)

| | |
|---|---|
| Amorphous resin particle dispersion (1) | 145 parts |
| Crystalline resin particle dispersion (2) | 30 parts |
| Colorant dispersion (1) | 42 parts |
| Release agent particle dispersion (1) | 36 parts |
| Inorganic particle dispersion (1) | 10 parts |
| Aluminum sulfate | 0.5 part |
| Deionized water | 300 parts |

The above materials are put into a round-bottom flask made of stainless steel, pH thereof is adjusted to 2.7, and the materials are dispersed using a homogenizer (manufactured by IKA, Ultra-Turrax T50). Thereafter, the resultant is heated up to 45° C. under stirring in an oil bath for heating, held at 48° C. for 120 minutes, and then stirred continuously under heating at 48° C. for 30 minutes. The pH of the dispersion at this point in time is 3.2. Subsequently, a 1 N aqueous sodium hydroxide solution is gently added thereto to adjust the pH thereof to 8.0, and the resultant is then heated up to 90° C. under stirring and held as is for 3 hours. Thereafter, the reaction product is filtered, washed with deionized water, and then dried using a vacuum drier, thereby obtaining toner particles (1).

The volume average particle size of the toner particles (1) is 3.8 μm.

Preparation of Toner (1)

The toner particles (1) are dispersed to be in an amount of 10% by weight in deionized water, and pH thereof is adjusted to 4.2 by using a aqueous hydrochloric acid solution diluted 50-fold. Polyethylenimine (manufactured by Junsei Chemical Co., Ltd., weight average molecular weight of 70,000) is added thereto in an amount of 1% by weight based on the amount of solid content of the toner particles, and the resultant is stirred for 1 hour. Subsequently, the toner particles are separated by a centrifugal separator and washed with deionized water, and this operation is repeated twice. Thereafter, the toner particles are dried by freeze-drying, thereby obtaining a toner (1) in which polyethylenimine has been bonded to the surface of the toner particles (1).

Preparation of Toner Particles (2)

The heating temperature or treatment time used in the "Preparation of toner particles (1)" is changed appropriately, thereby obtaining toner particles (2) having a volume average particle size of 2.8 μm.

Preparation of Toner (2)

A toner (2) is prepared in the same manner as in Preparation of toner (1), by using the toner particles (2) instead of the toner particles (1).

Preparation of Silicone Oil

As a carrier liquid of a liquid developer, the following silicone oil is prepared. In the following part, a surface charge density of the toner that is measured by dispersing the toner (1) at a solid content concentration of 30% by weight in the respective oil is also described.

Dimethyl silicone oil (manufactured by Shin-Etsu Chemical Co., Ltd., KF-96-20cs): 1 $\mu C/m^2$ or less Methyl hydrogen silicone oil (manufactured by Shin-Etsu Chemical Co., Ltd., KF-99-20cs): 18 $\mu C/m^2$ Preparation of Liquid Developer Example 1

The toner (1) is mixed with dimethyl silicone oil, thereby obtaining a liquid developer (A1) having a solid content concentration of 30% by weight.

Example 2

The toner (2) is mixed with dimethyl silicone oil, thereby obtaining a liquid developer (A2) having a solid content concentration of 30% by weight.

Example 3

Carboxylic acid-modified dimethyl silicone (manufactured by Shin-Etsu Chemical Co., Ltd., X-22-3710) as an ionization-controlling agent is added in an amount of 0.1% by weight to the liquid developer (A2), thereby obtaining a liquid developer (A3).

Comparative Example 1

The toner particles (1) are mixed with paraffin oil (MORESCO Corporation, P40), thereby obtaining a liquid developer (C1) having a solid content concentration of 30% by weight.

Comparative Example 2

The toner particles (1) are mixed with dimethyl silicone oil, thereby obtaining a liquid developer (C2) having a solid content concentration of 30% by weight.

Comparative Example 3

The toner particles (2) are mixed with dimethyl silicone oil, thereby obtaining a liquid developer (C3) having a solid content concentration of 30% by weight.

Comparative Example 4

The toner (1) is mixed with methyl hydrogen silicone oil, thereby obtaining a liquid developer (C4) having a solid content concentration of 30% by weight.

The constitution of the respective liquid developers of Examples 1 to 3 and Comparative examples 1 to 4 is summarized in Table 1.

TABLE 1

| | | Binder resin of toner particles | Volume average particle size of toner particles | Surface-modifying compound | Carrier liquid | Ionization-controlling agent |
|---|---|---|---|---|---|---|
| Example 1 | Liquid developer (A1) | Polyester resin | 3.8 μm | Polyethylenimine | Dimethyl silicone oil | — |
| Example 2 | Liquid developer (A2) | Polyester resin | 2.8 μm | Polyethylenimine | Dimethyl silicone oil | — |
| Example 3 | Liquid developer (A3) | Polyester resin | 2.8 μm | Polyethylenimine | Dimethyl silicone oil | Carboxylic acid-modified dimethyl silicone |
| Comparative example 1 | Liquid developer (C1) | Polyester resin | 3.8 μm | — | Paraffin oil | — |
| Comparative example 2 | Liquid developer (C2) | Polyester resin | 3.8 μm | — | Dimethyl silicone oil | — |
| Comparative example 3 | Liquid developer (C3) | Polyester resin | 2.8 μm | — | Dimethyl silicone oil | — |
| Comparative example 4 | Liquid developer (C4) | Polyester resin | 3.8 μm | Polyethylenimine | Methyl hydrogen silicone oil | — |

Evaluation I

The liquid developer (A1) is compared with the liquid developer (C1), in terms of the temporal maintainability of the surface potential of the toner in the liquid developer.

Figure 2:
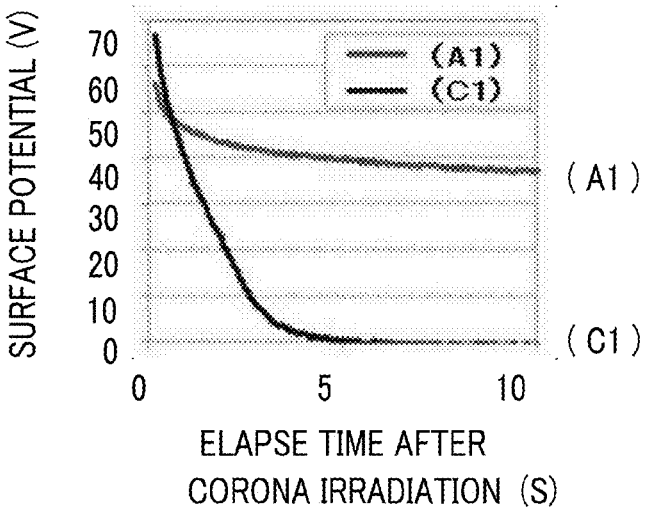
FIG. 2 is a graph of a surface potential of a toner that is measured in Evaluation I.

The liquid developer is coated onto a conductive substrate, thereby forming a liquid film having a thickness of 5 μm to 8 μm. The liquid film is charged positively by applying a voltage of 5.5 kV to a wire electrode by using a high-voltage power supply (manufactured by TREK JAPAN, 610C) to cause corona discharge from a distance of 7 mm. In addition, by using a surface potential meter (manufactured by TREK JAPAN, Model 344), a surface potential (V) of the toner is measured with the passage of time. The results are shown in FIG. 2 and Table 2.

TABLE 2

| Evaluation I | | 0 second | 2 seconds | 4 seconds | 6 seconds | 8 seconds | 10 seconds |
|---|---|---|---|---|---|---|---|
| Comparative example 1 | Liquid developer (C1) | 67 V | 29 V | 3 V | <1 V | <1 V | <1 V |
| Example 1 | Liquid developer (A1) | 58 V | 47 V | 40 V | 39 V | 38 V | 37 V |

The charge maintainability of toner is better in the liquid developer (A1) than in the liquid developer (C1).

Evaluation II

The liquid developer (A1) and the liquid developer (C2) are evaluated as follows.

Evaluation II-1

The temporal maintainability of the surface potential of toner in the liquid developer is examined.

Figure 3:
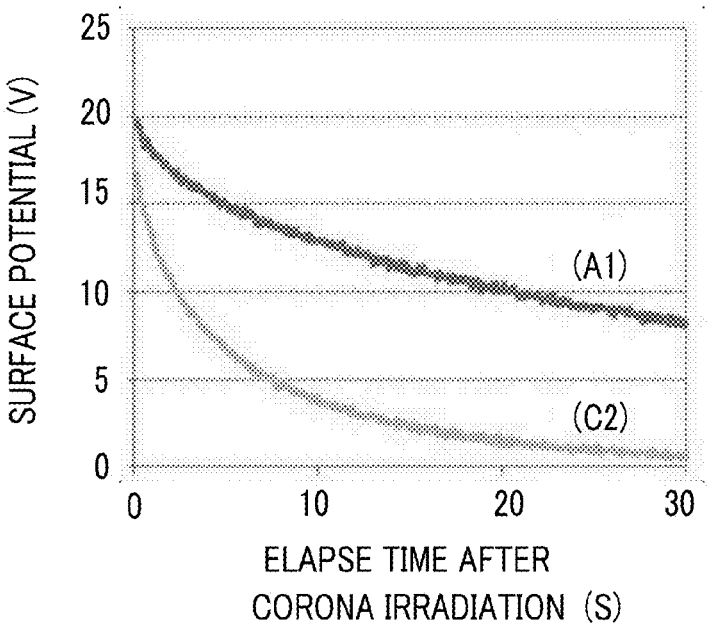
FIG. 3 is a graph of a surface potential of a toner that is measured in Evaluation II-1.

The liquid developer is coated onto a conductive substrate, thereby forming a liquid film having a thickness of 5 μm to 8 μm. The liquid film is charged positively by applying a voltage of 4 kV to a wire electrode by using a high-voltage power supply (manufactured by TREK JAPAN, 610C) to cause corona discharge from a distance of 7 mm. In addition, by using a surface potential meter (manufactured by TREK JAPAN, Model 344), a surface potential (V) of the toner is measured with the passage of time. The results are shown in FIG. 3 and Table 3.

TABLE 3

| Evaluation II-1 | | 0 second | 5 seconds | 10 seconds | 15 seconds | 20 seconds | 25 seconds | 30 seconds |
|---|---|---|---|---|---|---|---|---|
| Comparative example 2 | Liquid developer (C2) | 17 V | 7 V | 4 V | 2.5 V | 1.5 V | 1 V | <1 V |
| Example 1 | Liquid developer (A1) | 20 V | 15 V | 13 V | 12 V | 10 V | 9 V | 8 V |

The charge maintainability of toner is better in the liquid developer (A1) than in the liquid developer (C2).

Evaluation II-2

The maintainability of surface potential of the toner at the time when the toner passes through the developing nip is examined.

The liquid developer is provided to the developing roll and charged positively by causing an electric current of 1,000 μA to flow in a corona charger by using a high-pressure power supply (manufactured by TREK JAPAN, 610C). Subsequently, the liquid developer is caused to pass through a developing nip at a developing bias of −300 V and moved to a photoreceptor. At this time, by using a surface potential meter (manufactured by TREK JAPAN, Model 344), the surface potential (V) of the toner is measured on the developing roll which has been just charged by the corona charger and on the photoreceptor which just passed through the developing nip. The surface potential on the photoreceptor is shown in Table 4, as the relative value obtained when the surface potential on the developing roll is regarded as an index of 100.

TABLE 4

| Evaluation II-2 | | On developing roll | On photoreceptor |
|---|---|---|---|
| Comparative example 2 | Liquid developer (C2) | Index of 100 | Index of 62 |
| Example 1 | Liquid developer (A1) | Index of 100 | Index of 100 |

The surface potential of the toner in the liquid developer (C2) decreases by about 40%, but the surface potential of the toner in the liquid developer (A1) does not decrease.

Evaluation II-3

As an image forming apparatus for evaluation, MDP 1260 manufactured by Miyakoshi co., ltd. is prepared to examine the image quality obtained when an oil-removing roll is applied onto the photoreceptor. Conventionally, the oil-removing roll is a roll used for reducing the amount of residual carrier liquid on the roll and concentrating the toner. In order to inhibiting peeling of the toner, a reverse bias voltage is applied to the roll. However, if the charge amount of the toner is small, sometimes the image deteriorates since dots in the highlight portion of the image are lost due to the oil-removing roll.

In addition, the liquid developer (C2) is charged positively (set charge) by using a corona discharger on the photoreceptor immediately before the oil-removing roll is used, thereby enhancing responsiveness of the toner to the reverse bias voltage. The liquid developer (A1) is not charged with this set charge.

Figure 4A:
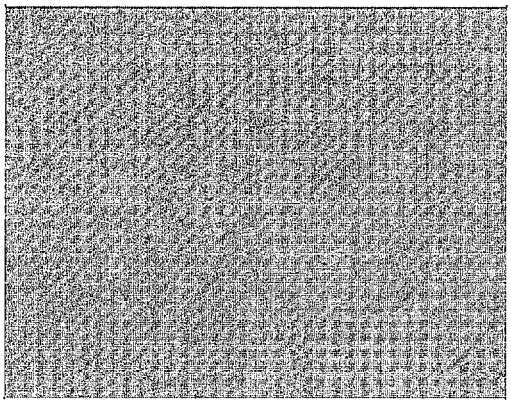
FIGS. 4A and 4B are pictures of images formed in Evaluation II-3.
Figure 4B:
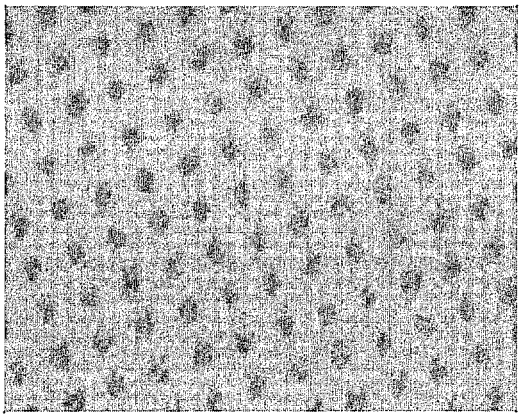

As an image for evaluation, 50 μmϕ dots are formed on paper (manufactured by Oji Paper Co., Ltd., Foam Gloss Double Side N, 85 gsm) at an interval of 154 μm. The picture of the image formed on the paper is shown in FIGS. 4A and 4B.

In the image formed of the liquid developer (02), dots in the highlight portion are lost. However, in the image formed of the liquid developer (A1), dots are reproduced excellently.

It is considered that the toner in the liquid developer (C2) loses charge in the nip, so responsiveness thereof to the reverse bias voltage decreases, and dots are peeled. Even when the liquid developer is charged with the set charge, peeling dots is not prevented.

On the other hand, it is considered that the toner in the liquid developer (A1) excellently maintains the surface potential when it passes through the nip, so the toner is pressed in the direction of the photoreceptor due to the reverse bias voltage, and peeling of dots is prevented even if the liquid developer is not charged with the set charge.

Evaluation III

Regarding the liquid developers (A1) to (A3), (C2), and (C3), the correlation between the charge amount of the toner in the liquid developer and the image quality is examined by the following method.

As an image forming apparatus for evaluation, MDP 1260 manufactured by Miyakoshi co., ltd. is prepared, and the toner is charged positively on the developing roll by using a corona discharger. In addition, the surface potential (V) of the toner is measured on the photoreceptor by using a surface potential meter (manufactured by TREK JAPAN, Model 344), and the charge amount (μC/g) of the toner on the photoreceptor is calculated from the surface potential and the weight of toner.

The image quality is evaluated using an index called color noise (CN) that is obtained by quantifying uneven density at a pitch of 1 mm or less. The results are shown in Table 5. The CN index is obtained by quantifying granularity as a value of sensory evaluation. The lower the index, the better the image quality.

TABLE 5

| Evaluation III | | Volume average particle size of toner particles | Surface modification | Ionization-controlling agent | Charge amount of toner [μC/g] | CN |
|---|---|---|---|---|---|---|
| Comparative example 2 | Liquid developer (C2) | 3.8 μm | − | − | 540 | 4.9 |
| Example 1 | Liquid developer (A1) | 3.8 μm | + | − | 620 | 4.6 |
| Comparative example 3 | Liquid developer (C3) | 2.8 μm | − | − | 1330 | 4.5 |
| Example 2 | Liquid developer (A2) | 2.8 μm | + | − | 1590 | 4.5 |
| Example 3 | Liquid developer (A3) | 2.8 μm | + | + | 1570 | 4.4 |

As shown in Table 5, as the charge amount per unit weight of the toner increases, the CN index tends to be lowered (uneven density is suppressed). Generally, it is considered that as the charge amount increases, the mirror-image force is strengthened, the strength of the toner attached to the developing roll increases, the toner becomes more resistant to the flow of liquid, whereby the image quality becomes excellent.

However, in the liquid developer (C3) and liquid developer (A2), the toner is charged to an extremely high degree. Accordingly, secondary troubles are caused, so the image quality is not that improved. On the other hand, since the image quality of the liquid developer (A3) is excellent, it is understood that the addition of the ionization-controlling agent is effective for adjusting the charge amount.

As seen from the comparison between the liquid developer (A1) and the liquid developer (C2), if the surface of toner is modified, the image quality is markedly improved. It is considered that the charge maintainability of the toner is improved by surface modification, and this leads to the improvement of image quality.

In the comparison between the liquid developer (C3) and the liquid developer (A2), the image quality is not improved to a large extent even if the surface of toner is modified. It is considered that since the mirror-image force in the liquid developer (A2) is too strong, the force of the toner attached to the developing roll is too strong, and the developing efficiency decreases, and accordingly, the final image quality is not that different from that of the liquid developer (C3).

As seen from the comparison between the liquid developer (A2) and the liquid developer (A3), adding 0.1% by weight of the ionization-controlling agent (carboxylic acid-modified dimethyl silicone) improves the image quality. It is considered that since a portion of an amino group of the toner surface is ionized due to the action of a carboxyl group of the ionization-controlling agent, the mirror-image force of the toner decreases within an appropriate range, the developing efficiency increases, and the image quality is improved.

Regarding the developing efficiency, the developing efficiencies of the liquid developer (C3), liquid developer (A2), and liquid developer (A3) are shown in Table 6, as a relative value obtained when the developing efficiency of the liquid developer (C3) is regarded as being 100%. The developing efficiency is measured by the following method.

The liquid film that is in a position in front and rear of the developing nip on the developing roll and the liquid film having been transferred to the photoreceptor are scraped off by a certain area by using gauze, and the weight of thereof is measured. From the weight and the concentration of developer in the respective liquid films that is determined by measuring an absorbance, the amount of toner on the respective rolls is calculated. In addition, from the proportion of the amount of toner, the developing efficiency is calculated.

TABLE 6

| Evaluation III | | Surface modification | Ionization-controlling agent | Developing efficiency |
|---|---|---|---|---|
| Comparative example 3 | Liquid developer (C3) | − | − | 100% |
| Example 2 | Liquid developer (A2) | + | − | 68% |
| Example 3 | Liquid developer (A3) | + | + | 90% |

Evaluation IV

The liquid developer (C4) is supplied with charge from a charger, and the charge amount of the toner and temporal maintainability of the charge amount are examined.

The liquid developer is coated onto a conductive substrate, thereby forming a liquid film having a thickness of 5 μm to 8 μm. The liquid film is supplied with positive charge by applying a voltage of 5.5 kV to a wire electrode by using a high-voltage power supply (manufactured by TREK JAPAN, 610C) to cause corona discharge from a distance of 7 mm. In addition, by using a surface potential meter (manufactured by TREK JAPAN, Model 344), a surface potential (V) of the toner is measured with the passage of time. The results are shown in Table 7. Table 7 also describes the results obtained from the liquid developer (A1) by Evaluation I.

TABLE 7

| Evaluation IV | | 0 second | 2 seconds | 4 seconds | 6 seconds | 8 seconds | 10 seconds |
|---|---|---|---|---|---|---|---|
| Comparative example 4 | Liquid developer (C4) | 48 V | 22 V | 4 V | 1.5 V | <1 V | <1 V |
| Example 1 | Liquid developer (A1) | 58 V | 47 V | 40 V | 39 V | 38 V | 37 V |

In the liquid developer (C4), the charge amount increases due to the supply of charge from a charger. However, the increase is not proportional to the amount of charge supplied and decreases easily with the passage of time.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid developer comprising:

a toner in which a compound having a charge-accepting functional group has been bonded to a surface of toner particles;

an ionization-controlling agent that ionizes the charge-accepting functional group; and a carrier liquid which makes a charge density of a surface of the toner become 1 $\mu C/m^2$ or less when the toner is dispersed in the carrier liquid, wherein the ionization-controlling agent is present in an amount of from 0.01% by weight to 0.5% by weight based on the liquid developer having a toner concentration of 30% by weight, and wherein the ionization-controlling agent is a silicone derivative selected from the group consisting of an acid-modified silicone, a hydrogen-modified silicone, a carboxyl-modified silicone, and an amino-modified silicone.

2. The liquid developer according to claim 1, wherein the carrier liquid is dimethyl silicone oil.

3. The liquid developer according to claim 1, wherein the toner particles contain a polyester resin, and the compound having a charge-accepting functional group is polyalkylenimine.

4. The liquid developer according to claim 2, wherein the toner particles contain a polyester resin, and the compound having a charge-accepting functional group is polyalkylenimine.

5. A liquid developer cartridge that accommodates the liquid developer according to claim 1 and is detachable from an image forming apparatus.

6. An image forming method comprising:

a first charging for charging a surface of an image holding member;

forming a latent image on a charged surface of the image holding member;

a second charging for charging a toner contained in a liquid developer;

developing the electrostatic latent image formed on the surface of the image holding member by using the liquid developer containing the toner charged by the second charging so as to form a toner image;

transferring the toner image to a recording medium; and fixing the toner image to the recording medium, wherein the liquid developer comprises:

a toner in which a compound having a charge-accepting functional group has been bonded to a surface of toner particles;

an ionization-controlling agent that ionizes the charge-accepting functional group; and a carrier liquid which makes a charge density of a surface of the toner become 1 $\mu C/m^2$ or less when the toner is dispersed in the carrier liquid, wherein the ionization-controlling agent is present in an amount of from 0.01% by weight to 0.5% by weight based on the liquid developer having a toner concentration of 30% by weight, and the ionization-controlling agent is a silicone derivative selected from the group consisting of an acid-modified silicone, a hydrogen-modified silicone, a carboxyl-modified silicone, and amino-modified silicone.

7. The image forming method according to claim 6, wherein the carrier liquid is dimethyl silicone oil.

8. The image forming method according to claim 6, wherein the toner particles contain a polyester resin, and the compound having a charge-accepting functional group is polyalkylenimine.

* * * * *